US011732327B2

(12) United States Patent
Leng et al.

(10) Patent No.: US 11,732,327 B2
(45) Date of Patent: Aug. 22, 2023

(54) NANO-CARBON REINFORCED ALUMINUM MATRIX COMPOSITES FOR CONDUCTOR AND PREPARATION METHOD

(71) Applicants: Nanjing Tech University, Nanjing (CN); Jinan Graphene Aluminum Materials Technology Co., Ltd., Jinan (CN)

(72) Inventors: Jinfeng Leng, Shangdong (CN); Qingbo Zhou, Shangdong (CN)

(73) Assignees: Nanjing Tech University, Nanjing (CN); Jinan Graphene Aluminum Materials Technology Co., Ltd., Jinan (CN)

( * ) Notice: Subject to any disclaimer, the term of this patent is extended or adjusted under 35 U.S.C. 154(b) by 147 days.

(21) Appl. No.: 17/106,195

(22) Filed: Nov. 30, 2020

(65) Prior Publication Data

US 2021/0172043 A1 Jun. 10, 2021

(30) Foreign Application Priority Data

Nov. 29, 2019 (CN) ..... 201911197032.4

(51) Int. Cl.

| | |
|---|---|
| ***C22C 1/02*** | (2006.01) |
| ***C22C 21/00*** | (2006.01) |
| ***C22F 1/04*** | (2006.01) |

(52) U.S. Cl.
CPC ..... *C22C 1/026* (2013.01); *C22C 21/00* (2013.01); *C22F 1/04* (2013.01)

(58) Field of Classification Search
CPC ..... C22C 1/026; C22C 21/00–18
See application file for complete search history.

(56) References Cited

FOREIGN PATENT DOCUMENTS

| | | |
|---|---|---|
| CN | 105385871 | 3/2016 |
| CN | 108396168 | 8/2018 |
| CN | 110295298 | 10/2019 |
| CN | 110331316 | 10/2019 |
| WO | WO-2022109587 A1 * | 5/2022 |

* cited by examiner

*Primary Examiner* — George Wyszomierski
*Assistant Examiner* — Janell C Morillo
(74) *Attorney, Agent, or Firm* — JCIPRNET

(57) ABSTRACT

A carbon nano reinforced aluminum matrix conductive composite and a preparation method thereof are provided. In the preparation method, nano silicon dioxide chemically grows on the surface of graphene oxide, reduced graphene oxide@silicon dioxide carbon nano powder is prepared and reduced in the process of high-temperature sintering, and the mixed powder is blown into a melt using an inert gas, and then stirred, purified and cast.

7 Claims, No Drawings

NANO-CARBON REINFORCED ALUMINUM MATRIX COMPOSITES FOR CONDUCTOR AND PREPARATION METHOD

CROSS-REFERENCE TO RELATED APPLICATION

This application claims the priority benefit of China application serial no. 201911197032.4, filed on Nov. 29, 2019. The entirety of the above-mentioned patent application is hereby incorporated by reference herein and made a part of this specification.

TECHNICAL FIELD

The disclosure relates to a nano phase reinforced aluminum matrix composite, particularly to an aluminum matrix composite and a preparation method.

BACKGROUND

For the problems of West to East power transmission, long-distance transmission with north-south mutual supply, large line loss and the like, which are to be urgently solved, higher requirements are put forward for the performances of overhead transmission lines, including low loss, large capability and toughness. This requires that the conductor material of the transmission line simultaneously considers high strength, high conductivity and heat resistance. The transmission conductor material having high conductivity is used to reduce line loss and improve transmission efficiency, the transmission conductor material having high heat resistance can improve the allowable operation temperature of the transmission line and improve limit conveying capacity (allowable carrying capacity), thereby ensuring the large capacity and toughness of the transmission line.

In 2004, British scientists first prepared a new two-dimensional atom crystal-graphene composed of carbon atoms in a $sp^2$ hybrid connected single-atom layer, which only has a thickness of 0.3354 nm, and is the thinnest material found in the world currently. The graphene has a special single-atom layer structure and extremely excellent physical property: Yong modulus 1100 GPa and ultimate tensile strength 125 GPa, which are equivalent to those of the carbon nano tube, has a thermal conductivity of about 5000 J/(m·K·s), and has the characteristics of low thermal expansion coefficient, minimum quantum conductivity under the zero carrier concentration limit and the like. The graphene having low density and excellent mechanical and thermal physical properties can be added into aluminum alloy as a reinforced phase, so as to obtain a composite material which is light in weight, high in strength, high in conductivity, high in thermal conductivity and high in thermal stability.

At present, there are few of reports about graphene reinforced metal matrix composites, preparation of the materials is at the stage of preliminary exploration. For the graphene reinforced metal matrix composites, the existing patent 1 (publication number (CN105385871A) describes that nano carbon whose surface is coated with a metal ion precursor is dispersed into aluminum powder, thermal sintering is carried out to obtain mixed powder, and the heat-resistant aluminum matrix composite is produced by using a conventional powder metallurgy process. The existing patent 2 (publication number (CN110331316) discloses a high-strength heat-resistant aluminum matrix composite conductor material and a preparation method, the graphene and aluminum powder are milled and mixed, and amorphous alumina is obtained on the surface of graphene, and the composite material is prepared by using a powder metallurgy sinter molding method. The existing patent 3 (publication number CN108396168A) describes that graphene and aluminum powder are mixed, canned and semi-solid extruded to prepare a composite material having a density of 98.5%. At present, the preparation method of the graphene aluminum matrix composite focuses on powder metallurgy, also includes cladding extrusion and semi-solid extrusion methods. These methods are high in mould cost and low in production rate, and difficult to batch and continuous industrial production. The existing patent 4 (CN110295298A) describes that a hydrothermal method is used to synthesize alumina@graphene, which is complex in chemical reaction process and complicated in particle size and particle diameter control of alumina, and renders reduction in conductivity due to easy introduction of impurities into molten aluminum, so the method is not suitable for the preparation of series 1 conductor materials. In view of the problems existing in the material application process, the unique component system design and process design are performed in this patent.

SUMMARY

The objective of the disclosure is to solve the problems of insufficient strength and heat resistance of series 1 conductor alloy and provide an aluminum matrix composite and a preparation method. Through a traditional alloying technology, the application bottleneck problem of conductivity is greatly reduced while improving the strength. The preparation method of the disclosure is simple in process, low in cost, strong in design, and suitable for continuous large-scale production of a water-cold semicontinuous casting or continuous casting and rolling process.

The disclosure is realized through the following technical solution:

Provided are a carbon nano reinforced aluminum matrix conductor material and a preparation method, wherein the carbon nano reinforced aluminum matrix conductor material consists of the following alloy components in percentage by mass: 0.01~0.07% of graphene, 0.06~0.5% of Zr, ≤0.08% of Fe, ≤0.04% of Si, ≤0.01% of each of rest elements and the balance of Al.

The preparation method of the above aluminum matrix composite comprises the following steps:

(1) putting an aluminum ingot into a resistance furnace when the temperature of the resistance furnace is raised to 400° C., wherein the purity of the aluminum ingot is greater than 99.7%;

(2) after the aluminum ingot is completely molten, adding Al-5Zr intermediate alloy under the condition that the temperature is raised to 720° C.~740° C., and carrying out heat preservation on the melt;

(3) blowing reduced graphene oxide @silicon dioxide powder into the aluminum melt using argon while stirring, until the mixed powder is completely blown;

(4) blowing a 6AB refining agent from Pyrotek company using argon, wherein the mass of the added refining agent is 1.0% that of the aluminum melt;

(5) standing and carrying out heat preservation for 5 min, then adding Al-5% Ti—B wires, slagging, discharging, and carrying out water-cold semicontinuous casting at 720740° C. to obtain a cast ingot; and forming $TiAl_3$ and $TiB_2$ after adding Al-5% Ti—B, and further refining grains without too excessive addition;

(6) cutting off the head and tail of the cast ingot, turning surface scales, and then carrying out extrusion deformation; and (7) using high-temperature solution and aging treatment to obtain the aluminum matrix composite.

Preferably, in the step (3), the graphene is 1-5 layers of graphene, and has a particle size of 5~20 microns.

Preferably, the preparation method of reduced graphene oxide@silicon dioxide in the step (3) is as follows: KH-550 silane coupling agent solution is prepared, a ratio of ethanol to water is 1~10:4~16, the content of KH-550 in the solution is 0.1 vol. %-1.5 vol. %, and hydrolysis is carried out for 2~6 h under the condition of standing; graphene oxide is added in the solution so that the concentration of graphene is 0.2~1.0 g/L, then silicon dioxide powder is added to undergo ultrasonic treatment for 60~120 min, the particle size of the nano silicon dioxide powder is 10 nm~50 nm, the solution is subjected to vacuum freeze drying, and then graphene oxide is subjected to reductive sintering for 1~5 h at a sintering temperature of 1200° C.~1500° C., so as to obtain reduced graphene oxide@silicon dioxide composite powder. More preferably, in the graphene@silicon dioxide composite powder, the mass of silicon dioxide is 0.5~5%.

Preferably, in the step (6), the extrusion heating temperature is 400~450° C., heat preservation time is 3~5 h, an extrusion ratio is 20~30:1, and an extrusion rate is 2.0~5.0 mm/min.

Preferably, in the step (7), the solution temperature is 570~610° C., and heat preservation time is 2~6 h; the aging temperature is 250~350° C., and heat preservation time is 24~72 h.

Zr is added in the aluminum melt to react with Al to generate a $Al_3Zr$ phase, the $Al_3Zr$ phase is a nano phase exhibiting dispersion distribution, which prevents dislocated slippage and climbing, grain boundary and sub-grain boundary can be pinned to prevent formation of sub-grain boundary due to dislocated rearrangement when heating and subsequent development of a large angle grain boundary, thereby delaying the nucleation of growth of recrystalization, improving the recrystalization temperature of the aluminum alloy matrix and promoting the heat resistance. However, addition amount and addition process of Zr need to be seriously controlled, significant reduction in conductivity can be caused when a certain addition amount is reached.

The disclosure has the beneficial effects:

(1) in the disclosure, ordinary aluminum alloy melting and casting equipment is adopted for production, the aluminum graphene@silicon dioxide mixed powder is blown into the melt by virtue of the traditional inert gas purification equipment, semi-continuous casting or continuous casting and rolling is conducted to produce large-size members. This method of the disclosure is uniform in texture, density in material, simple in process and high in production efficiency, avoids the defects of small size, high mould cost and low material density of the powder metallurgy technology, and is suitable for industrial large-scale production.

(2) the wetting angle of silicon dioxide/aluminum is smaller than that of graphene/aluminum, modification of silicon dioxide can increase the wetting angle between graphene and aluminum; and in the aluminum melt, silicon dioxide reacts with aluminum to generate alumina and silicon, and the reaction process further improves the wettability of graphene and aluminum melt and promotes the uniform dispersion of graphene in the aluminum melt.

(3) The strength of aluminum alloy is improved through an alloying pathway, which can lead to reduction in conductivity to different extents. Therefore, fine grain enhancement becomes an important means of series 1 alloy enhancement, the graphene@silicon dioxide having wettability with the matrix can serve as the particle of α-Al heterogeneous nucleation, and alloy is reinforced through fined grains.

(4) The graphene with a two-dimensional nanostructure has a super-large specific surface area, which can effectively prevent crack propagation and improve the strength and plasticity of aluminum alloy. The chemical properties of graphene at high temperature are stable, which ensures that the alloy in this patent has good heat resistance, the strength of series 1 alloy is significantly improved by 25% or more, the heat resistance is increased by 30° C.~50° C., and the conductivity is up to 61% IACS or more.

DESCRIPTION OF THE EMBODIMENTS

Next, examples of the disclosure will be described in detail. These examples are implemented on the premise of the technical solution of the disclosure, detailed embodiments and specific operation processes are given, but the protective scope of the disclosure is not limited to the following examples.

Example 1

Components of alloy: 0.07% of graphene, 0.30% of Zr, 0.008% of Fe, 0.038% of Si, 0.010% of Ti and the balance of Al. A preparation process of reduced graphene oxide @silicon dioxide and ratios were as follows: KH-550 silane coupling agent solution was prepared, a ratio of ethanol to water was 1:14, the content of KH-550 in the solution was 1.5 vol. %, and hydrolysis was carried out for 6 h under the condition of standing; graphene oxide having no more than 5 layers and an average particle size of 5 microns was added in the solution so that the concentration of graphene was 1.0 g/L, then silicon dioxide powder was added to undergo ultrasonic treatment for 100 min, the particle size of the nano silicon dioxide powder was 10 nm, the addition amount of nano silicon dioxide was 1.0% mass of graphene, the solution was subjected to vacuum freeze drying, and then graphene oxide was subjected to reductive sintering for 2 h at a sintering temperature of 1500° C., so as to obtain reduced graphene oxide@silicon dioxide composite powder. A furnace was cleaned before blowing in. Like production of alloy except series 1 alloy, it was needed to clean the furnace to reach the purpose of controlling the contents of impurity elements. When a resistance furnace was heated to 400° C., an aluminum ingot was put in the resistance furnace by a crane; the purity of the aluminum ingot was 99.85%, the aluminum melt was heated to 730° C. after the aluminum ingot was completely molten, and Al-5% Zr intermediate alloy was added. The reduced graphene oxide@silicon dioxide powder was blown into the aluminum melt using argon, the melt was sufficiently stirred using a stirring tool until the reduced graphene oxide@silicon dioxide powder was completely blown. A 6AB refining agent from Pyrotek company was blown using argon, the mass of the added refining agent was 1.0% that of the aluminum melt; Al-5% Ti—B wires were added after standing and carrying out heat preservation for 5 min, slagging was carried out, discharging was carried out at 720° C., and water-cold semicontinuous casting was carried out to obtain a cast ingot; the finished cast ingot product was hoisted out of a crystallizer, the head and tail of the cast ingot were cut off, and the surface scales were turned and then extruded and deformed; extrusion heating temperature was 400° C., heat preservation time was 5 h, an extrusion ratio was 25:1, and an extrusion rate was 3.0 mm/min; after extrusion, the solution temperature of a sectional material was 570° C., and heat preservation time was 6 h; the aging temperature was 300° C., and heat preservation time was 60 h.

Example 2

Components of alloy: 0.01% of graphene, 0.1% of Zr, 0.010% of Ti, 0.071% of Fe, 0.035% of Si, ≤0.01% of each of rest elements and the balance of Al. A preparation process and for synthesizing reduced graphene oxide@silicon dioxide in advance and ratios were as follows: KH-550 silane coupling agent solution was prepared, a ratio of ethanol to water was 10:4, the content of KH-550 in the solution was 1.2 vol. %, and hydrolysis was carried out for 6 h under the condition of standing; graphene oxide having no more than 3 layers and an average particle size of 20 microns was added in the solution so that the concentration of graphene was 1.0 g/L, then silicon dioxide powder was added to undergo ultrasonic treatment for 120 min, the particle size of the nano silicon dioxide powder was 50 nm, the addition amount of nano silicon dioxide was 5% mass of graphene, the solution was subjected to vacuum freeze drying, and then graphene oxide was subjected to reductive sintering for 2 h at a sintering temperature of 1500° C., so as to obtain reduced graphene oxide@silicon dioxide composite powder. A furnace was cleaned before blowing in. Like production of alloy except series 1 alloy, it was needed to clean the furnace to reach the purpose of controlling the contents of impurity elements. When a resistance furnace was heated to 400° C., an aluminum ingot was put in the resistance furnace by a crane; the aluminum melt was heated to 740° C. after the aluminum ingot was completely molten, and Al-5% Zr intermediate alloy was added. The reduced graphene oxide@silicon dioxide powder was blown into the aluminum melt using argon, the melt was sufficiently stirred using a stirring tool until the reduced graphene oxide@silicon dioxide powder was completely blown. A 6AB refining agent from Pyrotek company was blown using argon, the mass of the added refining agent was 1.0% that of the aluminum melt; Al-5% Ti—B wires were added after standing and carrying out heat preservation for 5 min, slagging was carried out, discharging was carried out at 720° C., and water-cold semicontinuous casting was carried out to obtain a cast ingot; the finished cast ingot product was hoisted out of a crystallizer, the head and tail of the cast ingot were cut off, and the surface scales were turned and then extruded and deformed; extrusion heating temperature was 400° C., heat preservation time was 3 h, an extrusion ratio was 25:1, and an extrusion rate was 2.0 mm/min; after extrusion, the solution temperature of a sectional material was 610° C., and heat preservation time was 4 h; the aging temperature was 350° C., and heat preservation time was 24 h.

Example 3

Components of alloy: 0.05% of graphene, 0.15% of Zr, 0.010% of Ti, 0.069% of Fe, 0.034% of Si, ≤0.01% of each of rest elements and the balance of Al. A preparation process for synthesizing reduced graphene oxide@silicon dioxide in advance and ratios were as follows: KH-550 silane coupling agent solution was prepared, a ratio of ethanol to water was 3:9, the content of KH-550 in the solution was 1.0 vol. %, and hydrolysis was carried out for 4 h under the condition of standing; graphene oxide having no more than 3 layers and an average particle size of 15 microns was added in the solution so that the concentration of graphene was 0.8 g/L, then silicon dioxide powder was added to undergo ultrasonic treatment for 60 min, the particle size of the nano silicon dioxide powder was 10 nm, the addition amount of nano silicon dioxide was 5% mass of graphene, the solution was subjected to vacuum freeze drying, and then graphene oxide was subjected to reductive sintering for 4 h at a sintering temperature of 1200° C., so as to obtain reduced graphene oxide@silicon dioxide composite powder. A furnace was cleaned before blowing in. Like production of alloy except series 1 alloy, it was needed to clean the furnace to reach the purpose of controlling the contents of impurity elements. When a resistance furnace was heated to 400° C., 99.86% of aluminum ingot was put in the resistance furnace by a crane; the aluminum melt was heated to 730° C. after the aluminum ingot was completely molten, and Al-5% Zr intermediate alloy was added. The reduced graphene oxide@silicon dioxide powder was blown into the aluminum melt using argon, the melt was sufficiently stirred using a stirring tool until the reduced graphene oxide@silicon dioxide powder was completely blown. A 6AB refining agent from Pyrotek company was blown using argon, the mass of the added refining agent was 1.0% that of the aluminum melt; Al-5% Ti—B wires were added after standing and carrying out heat preservation for 5 min, slagging was carried out, discharging was carried out at 720° C., and water-cold semicontinuous casting was carried out to obtain a cast ingot; the finished cast ingot product was hoisted out of a crystallizer, the head and tail of the cast ingot were cut off, and the surface scales were turned and then extruded and deformed; extrusion heating temperature was 450° C., heat preservation time was 4 h, an extrusion ratio was 30:1, and an extrusion rate was 2.0 mm/min; after extrusion, the solution temperature of a sectional material was 600° C., and heat preservation time was 5 h; the aging temperature was 350° C., and heat preservation time was 60 h.

Example 4

Components of alloy: 0.07% of graphene, 0.2% of Zr, 0.071% of Fe, 0.034% of Si, 0.010% of Ti, and the balance of Al. A preparation process of reduced graphene oxide @silicon dioxide and ratios were as follows: KH-550 silane coupling agent solution was prepared, a ratio of ethanol to water was 2:14, the content of KH-550 in the solution was 1.2 vol. %, and hydrolysis was carried out for 5 h under the condition of standing; graphene oxide having no more than 3 layers and an average particle size of 1 microns was added in the solution so that the concentration of graphene was 1.0 g/L, then silicon dioxide powder was added to undergo ultrasonic treatment for 60 min, the particle size of the nano silicon dioxide powder was 25 nm, the addition amount of nano silicon dioxide was 0.5% mass of graphene, the solution was subjected to vacuum freeze drying, and then graphene oxide was subjected to reductive sintering for 3 h at a sintering temperature of 1350° C., so as to obtain reduced graphene oxide@silicon dioxide composite powder. A furnace was cleaned before blowing in. Like production of alloy except series 1 alloy, it was needed to clean the furnace to reach the purpose of controlling the contents of impurity elements. When a resistance furnace was heated to 400° C., the aluminum ingot was put in the resistance furnace by a crane; the purity of the aluminum ingot was 99.85%, the aluminum melt was heated to 730° C. after the aluminum ingot was completely molten, and Al-5% Zr intermediate alloy was added. The reduced graphene oxide@silicon dioxide powder was blown into the aluminum melt using argon, the melt was sufficiently stirred using a stirring tool until the reduced graphene oxide@silicon dioxide powder was completely blown. A 6AB refining agent from Pyrotek company was blown using argon, the mass of the added refining agent was 1.0% that of the aluminum melt; Al-5% Ti—B wires were added after standing and carrying out heat preservation for 5 min, slagging was carried out, discharging was carried out at 720° C., and water-cold semicontinuous casting was carried out to obtain a cast ingot; the finished cast ingot product was hoisted out of a crystallizer, the head and tail of the cast ingot were cut off, and the surface scales were turned and then extruded and deformed; extrusion heating temperature was 420° C., heat preservation time was 3 h, an extrusion ratio was 20:1, and an extrusion rate was 2.0 mm/min; after extrusion, the solution temperature of a sectional material was 580° C., and heat preservation time was 5 h; the aging temperature was 350° C., and heat preservation time was 50 h.

Example 5

Components of alloy: 0.02% of graphene, 0.2% of Zr, 0.075% of Fe, 0.039% of Si, 0.010% of Ti, and the balance of Al. A preparation process of reduced graphene oxide@silicon dioxide in advance and ratios were as follows: KH-550 silane coupling agent solution was prepared, a ratio of ethanol to water was 2:12, the content of KH-550 in the solution was 1.0 vol. %, and hydrolysis was carried out for 5 h under the condition of standing; graphene oxide having no more than 3 layers and an average particle size of 10 microns was added in the solution so that the concentration of graphene was 3.0 g/L, then silicon dioxide powder was added to undergo ultrasonic treatment for 60 min, wherein the particle size of the nano silicon dioxide powder was 10 nm, the addition amount of nano silicon dioxide was 2% mass of graphene, the solution was subjected to vacuum freeze drying, and then graphene oxide was subjected to reductive sintering for 6 h at a sintering temperature of 1000° C., so as to obtain reduced graphene oxide@silicon dioxide composite powder. A furnace was cleaned before blowing in. Like production of alloy except series 1 alloy, it was needed to clean the furnace to reach the purpose of controlling the contents of impurity elements. When a resistance furnace was heated to 400° C., the aluminum ingot was put in the resistance furnace by a crane; the purity of the aluminum ingot was 99.84%, the aluminum melt was heated to 730° C. after the aluminum ingot was completely molten, and Al-5% Zr intermediate alloy was added. The reduced graphene oxide@silicon dioxide powder was blown into the aluminum melt using argon, the melt was sufficiently stirred using a stirring tool until the reduced graphene oxide@silicon dioxide powder was completely blown. A 6AB refining agent from Pyrotek company was blown using argon, the mass of the added refining agent was 1.0% that of the aluminum melt; Al-5% Ti—B wires were added after standing and carrying out heat preservation for 5 min, slagging was carried out, discharging was carried out at 720° C., and water-cold semicontinuous casting was carried out to obtain a cast ingot; the finished cast ingot product was hoisted out of a crystallizer, the head and tail of the cast ingot were cut off, and the surface scales were turned and then extruded and deformed; extrusion heating temperature was 450° C., heat preservation time was 4 h, an extrusion ratio was 25:1, and an extrusion rate was 4.0 mm/min; after extrusion, the solution temperature of a sectional material was 580° C., and heat preservation time was 6 h; the aging temperature was 330° C., and heat preservation time was 48 h.

Example 6

Components of alloy: 0.07% of graphene, 0.1% of Zr, 0.073% of Fe, 0.032% of Si, 0.010% of Ti, and the balance of Al. A preparation process of reduced graphene oxide@silicon dioxide and ratios were as follows: KH-550 silane coupling agent solution was prepared, a ratio of ethanol to water was 1:16, the content of KH-550 in the solution was 1.4 vol. %, and hydrolysis was carried out for 5 h under the condition of standing; graphene oxide having no more than 5 layers and an average particle size of 15 microns was added in the solution so that the concentration of graphene was 1.0 g/L, then silicon dioxide powder was added to undergo ultrasonic treatment for 80 min, wherein the particle size of the nano silicon dioxide powder was 10 nm, the addition amount of nano silicon dioxide was 1.5% mass of graphene, the solution was subjected to vacuum freeze drying, and then graphene oxide was subjected to reductive sintering for 6 h at a sintering temperature of 1000° C., so as to obtain reduced graphene oxide@silicon dioxide composite powder. A furnace was cleaned before blowing in. Like production of alloy except series 1 alloy, it was needed to clean the furnace to reach the purpose of controlling the contents of impurity elements. When a resistance furnace was heated to 400° C., the aluminum ingot was put in the resistance furnace by a crane; the purity of the aluminum ingot was 99.86%, the aluminum melt was heated to 740° C. after the aluminum ingot was completely molten, and Al-5% Zr intermediate alloy was added. The reduced graphene oxide@silicon dioxide powder was blown into the aluminum melt using argon, the melt was sufficiently stirred using a stirring tool until the reduced graphene oxide@silicon dioxide powder was completely blown. A 6AB refining agent from Pyrotek company was blown using argon, the mass of the added refining agent was 1.0% that of the aluminum melt; Al-5% Ti—B wires were added after standing and carrying out heat preservation for 5 min, slagging was carried out, discharging was carried out at 725° C., and water-cold semicontinuous casting was carried out to obtain a cast ingot; the finished cast ingot product was hoisted out of a crystallizer, the head and tail of the cast ingot were cut off, and the surface scales were turned and then extruded and deformed; extrusion heating temperature was 420° C., heat preservation time was 4 h, an extrusion ratio was 25:1, and an extrusion rate was 4.0 mm/min; after extrusion, the solution temperature of a sectional material was 580° C., and heat preservation time was 5 h; the aging temperature was 350° C., and heat preservation time was 48 h.

Comparative Example 1 (without Addition of Reduced Graphene Oxide@Silicon Dioxide and Zirconium)

Components of alloy: 0.078% of Fe, 0.038% of Si, ≤0.01% of each of rest elements and the balance of Al. A furnace was cleaned before blowing in. Like production of alloy except series 1 alloy, it was needed to clean the furnace to reach the purpose of controlling the contents of impurity elements. When a resistance furnace was heated to 400° C., the aluminum ingot was put in the resistance furnace by a crane; the aluminum melt was heated to 740° C. after the aluminum ingot was completely molten. A 6AB refining agent from Pyrotek company was blown using argon, the mass of the added refining agent was 1.0% that of the aluminum melt; Al-5% Ti—B wires were added according to Ti content of 0.010% after standing and carrying out heat preservation for 5 min, slagging was carried out, discharging was carried out at 720° C. for casting, and water-cold semicontinuous casting was carried out to obtain a cast ingot; the finished cast ingot product was hoisted out of a crystallizer, the head and tail of the cast ingot were cut off, and the surface scales were turned and then extruded and deformed; extrusion heating temperature was 400° C., heat preservation time was 5 h, an extrusion ratio was 25:1, and an extrusion rate was 4.0 mm/min; after extrusion, the solution temperature of a sectional material was 580° C., and heat preservation time was 6 h; the aging temperature was 250° C., and heat preservation time was 48 h.

Comparative Example 2 (No Graphene Modification, Upward Floating of Graphene, Failed Addition, and Reduction in Material Performance)

Components of alloy: 0.07% of graphene, 0.2% of Zr, 0.074% of Fe, 0.037% of Si, 0.010% of Ti and the balance of Al. A furnace was blown in. When a resistance furnace was heated to 400° C., the aluminum ingot was put in the resistance furnace by a crane; the aluminum melt was heated to 730° C. after the aluminum ingot was completely molten, and Al-5% Zr intermediate alloy was added. The reduced graphene oxide was blown into the aluminum melt using argon, the melt was sufficiently stirred using a stirring tool until the reduced graphene oxide was completely blown, it was found that graphene floated on the surface of the melt so addition was failed. A 6AB refining agent from Pyrotek company was blown using argon, the mass of the added refining agent was 1.0% that of the aluminum melt; Al-5% Ti—B wires were added after standing and carrying out heat preservation for 5 min, slagging was carried out, discharging was carried out at 750° C., and water-cold semicontinuous casting was carried out to obtain a cast ingot; the finished cast ingot product was hoisted out of a crystallizer, the head and tail of the cast ingot were cut off, and the surface scales were turned and then extruded and deformed; extrusion heating temperature was 400° C., heat preservation time was 5 h, an extrusion ratio was 25:1, and an extrusion rate was 4.0 mm/min; after extrusion, the solution temperature of a sectional material was 580° C., and heat preservation time was 6 h; the aging temperature was 250° C., and heat preservation time was 48 h.

Comparative Example 3 (without Addition of Reduced Graphene Oxide@Silicon Dioxide)

Components of alloy: 0.3% of Zr, 0.072% of Fe, 0.035% of Si, ≤0.01% of each of rest elements and the balance of Al. A furnace was cleaned before blowing in. Like production of alloy except series 1 alloy, it was needed to clean the furnace to reach the purpose of controlling the contents of impurity elements. When a resistance furnace was heated to 400° C., the aluminum ingot was put in the resistance furnace by a crane; the aluminum melt was heated to 730° C. after the aluminum ingot was completely molten. A 6AB refining agent from Pyrotek company was blown using argon, the mass of the added refining agent was 1.0% that of the aluminum melt; Al-5% Ti—B wires were added according to Ti content of 0.010% after standing and carrying out heat preservation for 5 min, slagging was carried out, discharging was carried out at 720° C. for casting, and water-cold semicontinuous casting was carried out to obtain a cast ingot; the finished cast ingot product was hoisted out of a crystallizer, the head and tail of the cast ingot were cut off, and the surface scales were turned and then extruded and deformed; extrusion heating temperature was 400° C., heat preservation time was 5 h, an extrusion ratio was 30:1, and an extrusion rate was 4.0 mm/min; after extrusion, the solution temperature of a sectional material was 600° C., and heat preservation time was 4 h; the aging temperature was 300° C., and heat preservation time was 48 h.

Comparative Example 4 (without Addition of Zr Element)

Components of alloy: 0.07% of graphene, 0.067% of Fe, 0.032% of Si, 0.010% of Ti and the balance of Al. A preparation process of reduced graphene oxide@silicon dioxide and ratios were as follows: KH-550 silane coupling agent solution was prepared, a ratio of ethanol to water was 0.5:14, the content of KH-550 in the solution was 1.2 vol. %, and hydrolysis was carried out for 2 h under the condition of standing; graphene oxide having no more than 5 layers and an average particle size of 10 microns was added in the solution so that the concentration of graphene was 2.0 g/L, then silicon dioxide powder was added to undergo ultrasonic treatment for 60 min, the particle size of the nano silicon dioxide powder was 40 nm, the addition amount of nano silicon dioxide was 2% mass of graphene, the solution was subjected to vacuum freeze drying, and then graphene oxide was subjected to reductive sintering for 6 h at a sintering temperature of 1000° C., so as to obtain reduced graphene oxide@silicon dioxide composite powder. A furnace was cleaned before blowing in. Like production of alloy except series 1 alloy, it was needed to clean the furnace to reach the purpose of controlling the contents of impurity elements. When a resistance furnace was heated to 400° C., the aluminum ingot was put in the resistance furnace by a crane; the aluminum melt was heated to 730° C. after the aluminum ingot was completely molten. The reduced graphene oxide@silicon dioxide powder was blown into the aluminum melt using argon, the melt was sufficiently stirred using a stirring tool until the reduced graphene oxide@silicon dioxide powder was completely blown. A 6AB refining agent from Pyrotek company was blown using argon, the mass of the added refining agent was 1.0% that of the aluminum melt; Al-5% Ti—B wires were added according to Ti content of 0.012% after standing and carrying out heat preservation for 5 min, slagging was carried out, discharging was carried out at 720° C. for casting, and water-cold semicontinuous casting was carried out to obtain a cast ingot; the finished cast ingot product was hoisted out of a crystallizer, the head and tail of the cast ingot were cut off, and the surface scales were turned and then extruded and deformed; extrusion heating temperature was 400° C., heat preservation time was 5 h, an extrusion ratio was 30:1, and an extrusion rate was 4.0 mm/min; after extrusion, the solution temperature of a sectional material was 600° C., and heat preservation time was 4 h; the aging temperature was 300° C., and heat preservation time was 48 h.

Comparative Example 5 (Solution Temperature and Aging Temperature were Reduced)

Components of alloy: 0.07% of graphene, 0.3% of Zr, 0.067% of Fe, 0.032% of Si, 0.010% of Ti and the balance of Al. A preparation process of reduced graphene oxide@silicon dioxide and ratios were as follows: KH-550 silane coupling agent solution was prepared, a ratio of ethanol to water was 0.5:14, the content of KH-550 in the solution was 1.2 vol. %, and hydrolysis was carried out for 2 h under the condition of standing; graphene oxide having no more than 3 layers and an average particle size of 20 microns were added in the solution so that the concentration of graphene was 3.0 g/L, then silicon dioxide powder was added to undergo ultrasonic treatment for 60 min, the particle size of the nano silicon dioxide powder was 30 nm, the addition amount of nano silicon dioxide was 2% mass of graphene, the solution was subjected to vacuum freeze drying, and then graphene oxide was subjected to reductive sintering for 6 h at a sintering temperature of 1000° C., so as to obtain reduced graphene oxide@silicon dioxide composite powder. A furnace was cleaned before blowing in. Like production of alloy except series 1 alloy, it was needed to clean the furnace to reach the purpose of controlling the contents of impurity elements. When a resistance furnace was heated to 400° C., the aluminum ingot was put in the resistance furnace by a crane; the aluminum melt was heated to 730° C. after the aluminum ingot was completely molten, and Al-5% Zr intermediate alloy was added. The reduced graphene oxide@silicon dioxide powder was blown into the aluminum melt using argon, the melt was sufficiently stirred using a stirring tool until the reduced graphene oxide@silicon dioxide powder was completely blown. A 6AB refining agent from Pyrotek company was blown using argon, the mass of the added refining agent was 1.0% that of the aluminum melt; Al-5% Ti—B wires were added after standing and carrying out heat preservation for 5 min, slagging was carried out, discharging was carried out at 720° C., and water-cold semicontinuous casting was carried out to obtain a cast ingot; the finished cast ingot product was hoisted out of a crystallizer, the head and tail of the cast ingot were cut off, and the surface scales were turned and then extruded and deformed; extrusion heating temperature was 300° C., heat preservation time was 5 h, an extrusion ratio was 15:1, and an extrusion rate was 4.0 mm/min; after extrusion, the solution temperature of a sectional material was 400° C., and heat preservation time was 6 h; the aging temperature was 180° C., and heat preservation time was 60 h.

| Number | Tensile strength (MPa) | Conductivity (% IACS) | Tensile strength (MPa) 180°C/400 h heat preservation | Conductivity (% IACS) 180° C./400 h heat preservation | Tensile strength (MPa) 230° C./1 h heat preservation | Conductivity (% IACS) 230° C./1 h heat preservation |
|---|---|---|---|---|---|---|
| Example 1 | 163 | 61.2 | 154 | 59.7 | 157 | 59.4 |
| Example 2 | 161 | 61.4 | 155 | 59.1 | 159 | 59.0 |
| Example 3 | 176 | 61.3 | 159 | 59.2 | 167 | 59.1 |
| Example 4 | 181 | 61.2 | 165 | 59.6 | 170 | 59.5 |
| Example 5 | 180 | 61.1 | 168 | 59.2 | 171 | 59.1 |
| Example 6 | 173 | 61.3 | 148 | 59.3 | 149 | 59.2 |
| Comparative example 1 | 115 | 61.4 | 75 | 58.8 | 64 | 58.4 |
| Comparative example 2 | 87 | 57.2 | 58 | 55.3 | 62 | 55.8 |
| Comparative example 3 | 142 | 61.3 | 121 | 59.1 | 125 | 58.7 |
| Comparative example 4 | 148 | 61.2 | 128 | 58.7 | 132 | 58.5 |
| Comparative example 5 | 143 | 58.5 | 115 | 57.2 | 120 | 57.0 |

Obviously, those skilled in the art can make various variations and transformations to the disclosure without departing from the spirit and scope of the disclosure. In this way, if these variations and transformations of the disclosure belong to the scopes of claims of the disclosure and equivalent technologies thereof, the disclosure is also intended to include these variations and transformations.

What is claimed is:

1. A carbon nano reinforced aluminum matrix conductive composite, consisting of the following alloy components in percentage by mass:

0.01~0.07% of graphene, 0.1~0.6% of Zr,

≤0.08% of Fe,

≤0.04% of Si, other elements≤0.01% each, and the balance of Al, wherein the other elements include Ti and impurities.

2. A preparation method of the carbon nano reinforced aluminum matrix conductive composite according to claim 1, comprising the following steps:

(1) putting an aluminum ingot into a resistance furnace when a temperature of a resistance furnace is raised to 400° C.;

(2) heating the aluminum ingot until said ingot is completely molten, raising the temperature to 710-730° C. and adding Al-5Zr intermediate alloy, and carrying out heat preservation to form an aluminum melt;

(3) blowing reduced graphene oxide@silicon dioxide composite powder into the aluminum melt using argon while stirring, until the reduced graphene oxide@silicon dioxide composite powder is completely blown;

(4) blowing a 6AB refining agent from Pyrotek company using argon, wherein a mass of the added refining agent is 1.2% that of the aluminum melt;

(5) standing and carrying out heat preservation for 5 min, then adding Al-5% Ti—B wires, slagging, discharging, and carrying out water-cold semicontinuous casting to obtain a cast ingot;

(6) cutting off a head and tail of the cast ingot, turning surface scales, and then carrying out extrusion deformation; and (7) using high-temperature solution and aging treatment to obtain the carbon nano reinforced aluminum matrix conductive composite.

3. The preparation method according to claim 2, wherein a preparation method of reduced graphene oxide@silicon dioxide composite powder in the step (3) is as follows: KH-550 silane coupling agent solution is prepared, a ratio of ethanol to water is 1~10:4~16, a content of KH-550 in the solution is 0.1 vol. %~1.5 vol. %, and hydrolysis is carried out for 2-6 h under a condition of standing; graphene oxide is added in the solution so that a concentration of graphene is 0.2~1.0 g/L, then silicon dioxide powder is added to undergo ultrasonic treatment for 60~120 min, a particle size of the silicon dioxide powder is 10 nm~50 nm, the solution is subjected to vacuum freeze drying, and then graphene oxide is subjected to reductive sintering for 1-5 h at a sintering temperature of 1200° C.~1500° C., so as to obtain the reduced graphene oxide@silicon dioxide composite powder.

4. The preparation method according to claim 3, wherein in the step (3), the graphene oxide is 1-5 layers of graphene oxide, and has a particle size of 5~20 microns.

5. The preparation method according to claim 3, wherein in the reduced graphene oxide@silicon dioxide composite powder, a mass of silicon dioxide is 0.5~5%.

6. The preparation method according to claim 2, wherein in the step (6), a extrusion heating temperature is 400~450° C., heat preservation time is 3~5 h, an extrusion ratio is 20~30:1, and an extrusion rate is 2.0~5.0 mm/min.

7. The preparation method according to claim 2, wherein in the step (7), a solution temperature is 570-610° C. with a heat preservation time of 2-6 h; and an aging temperature is 250-350° C. with a heat preservation time of 24-72 h.

* * * * *